US007228092B2

(12) United States Patent
Nomura et al.

(10) Patent No.: US 7,228,092 B2
(45) Date of Patent: Jun. 5, 2007

(54) IMAGE FORMING APPARATUS USING A LIQUID DEVELOPER INCLUDING A CARRIER LIQUID WITH TONER PARTICLES DISPERSED IN A SOLVENT

(75) Inventors: Yuko Nomura, Kawasaki (JP); Hideki Nukada, Yokohama (JP); Yasushi Shinjo, Kawasaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 11/272,865

(22) Filed: Nov. 15, 2005

(65) Prior Publication Data

US 2006/0104668 A1 May 18, 2006

(30) Foreign Application Priority Data

Nov. 16, 2004 (JP) ..... 2004-331618

(51) Int. Cl.
*G03G 15/10* (2006.01)

(52) U.S. Cl. ..... 399/249

(58) Field of Classification Search ..... 399/249
See application file for complete search history.

(56) References Cited

U.S. PATENT DOCUMENTS 3,942,888 A * 3/1976 Maksymiak et al. ..... 399/313
4,056,315 A * 11/1977 Ariyama et al. ..... 399/249
4,286,039 A 8/1981 Landa et al.
4,353,639 A * 10/1982 Moraw et al. ..... 399/249
5,028,964 A 7/1991 Landa et al.
5,332,642 A 7/1994 Simms et al.
6,305,860 B1 * 10/2001 Park ..... 400/636.3
6,370,347 B1 * 4/2002 Shin et al. ..... 399/249
6,529,700 B2 3/2003 Nukada et al.
6,650,857 B2 * 11/2003 Nukada et al. ..... 399/249
2005/0220496 A1 10/2005 Nomura et al.

FOREIGN PATENT DOCUMENTS

JP 7-225516 8/1995
JP 2000-347520 12/2000

* cited by examiner

*Primary Examiner*—David M. Gray
*Assistant Examiner*—Bryan Ready
(74) *Attorney, Agent, or Firm*—Oblon, Spivak, McClelland, Maier & Neustadt, P.C.

(57) ABSTRACT

In liquid-developing image formation, a ghost image caused by the contact between a photosensitive member and an absorbing roller to collect a surplus liquid developer is prevented by preventing occurrence of a speed difference (relative speed) between a photosensitive member and a porous member (an absorbing roller) and by keeping an optimum pressing force from a porous member to a visible image on a photosensitive member.

20 Claims, 9 Drawing Sheets

IMAGE FORMING APPARATUS USING A LIQUID DEVELOPER INCLUDING A CARRIER LIQUID WITH TONER PARTICLES DISPERSED IN A SOLVENT

CROSS-REFERENCE TO RELATED APPLICATIONS

This application is based upon and claims the benefit of priority from prior Japanese Patent Application No. 2004-331618, filed Nov. 16, 2004, the entire contents of which are incorporated herein by reference.

BACKGROUND OF THE INVENTION

1. Field of the Invention

The present invention relates to an image forming apparatus using a liquid developer including a carrier liquid with toner particles dispersed in solvent.

2. Description of the Related Art

An electrophotographic recording apparatus using a liquid developer has been revalued in recent years. An electrophotographic recording apparatus has advantages not realized by a dry-type electrophotographic recording apparatus, for example, high picture quality equal to offset printing by using very fine submicron toner particles, low copy cost with sufficient image density due to small amount of toner particles, and energy-saving by fixing toner particles to a recording paper sheet at a relatively low temperature.

As a transfer system of an electrophotographic recording apparatus using a liquid developer, a type using a shearing force is proposed by Jpn. Pat. Appln. KOKAI Publication No. 2000-347520. This system increases the transferability by giving a shearing force to a visible image.

It is necessary for giving a visible image a sufficient shearing force to increase a condensing force of toner particles by eliminating a surplus carrier liquid remained in and close to a visible image formed on a photosensitive member.

As a known method of eliminating the surplus carrier liquid, there is a roller absorbing method which absorbs a carrier liquid by forming a nip by making contact between a porous member formed on the outside of a roller contact and a photosensitive member.

The roller absorbing method has an advantage of increasing and maintaining the absorbing force of a porous member by providing a means for pulling in a surplus carrier liquid absorbed by the porous member. This method can be enhanced in the speed compared with the other methods of eliminating a surplus carrier liquid. Further, the method does not stain the inside of an apparatus, and saves energy. A surplus carrier liquid can be collected as a liquid, which makes it very suitable for recycling the solvent. Clogging of the porous member can be prevented by providing a cleaning roller for cleaning the porous member, and the carrier liquid elimination performance can be held stably for a long period.

However, the roller absorbing method has such problems as a speed difference (relative speed) between the porous member and photosensitive member, and a transfer of a visible image on the photosensitive member to the roller by an excessive pressing force, causing a disturbance in a visible image. A disturbance in a visible image (hereinafter called a ghost image) is also caused due to the visible image adhering to the absorbing roller being transferred again to the photosensitive member.

Many proposals have been made for the roller absorbing method. In particular, Jpn. Pat. Appln. KOKAI Publication No. 7-225516 proposed to contact a porous absorbing roller covered with a porous layer with electrical conductivity and elasticity to a breathable porous sleeve with electric conductivity and rigidity, so as to form an even nip in substantially the total width of a photosensitive member, and rotate the roller as a follower of the sleeve.

This method has an advantage that a speed difference (relative speed) is not generated between the porous absorbing roller and photosensitive member. Further, to keep the nip constant, a tracking roller is provided at both ends of the porous absorbing roller, to contact the photosensitive member and keep the distance constant.

However, even in the method disclosed in the Jpn. Pat. Appln. KOKAI Publication No. 7-225516, a pressing force in the nip is increased to obtain a nip capable of transmitting a driving force to the porous absorbing roller without generating a relative speed (speed difference) between the porous member and photosensitive member. Further, the nip is evenly formed in substantially the total width of the photosensitive member including the part to form a visible image, giving a large pressing force also to a visible image. This raises a problem that a ghost image (a visible image adhered to the porous absorbing roller is transferred again to the photosensitive member) is not prevented.

BRIEF SUMMARY OF THE INVENTION

It is an object of the present invention to provide an image forming apparatus, which can prevent a ghost image caused by the contact between a photosensitive member and an absorbing roller to collect a surplus liquid developer, in an image forming apparatus by liquid process for forming a visible image using a liquid developer.

According to an aspect of the present invention, there is provided an image forming apparatus comprising:

a photosensitive member having an image area and a non-image area;

an image forming unit which forms an electrostatic latent image on the image area of the photosensitive member;

a developing unit to develop the electrostatic latent image to form a visible image on the photosensitive member by supplying the photosensitive member with a carrier liquid and a liquid developer having toner particles; and an absorbing roller, being pressed to the photosensitive member, to absorb a part of the carrier liquid left on the photosensitive member, wherein the image area of the photosensitive member is pressed with a first pressure by the absorbing roller, while the non-image area of the photosensitive member is pressed with a second pressure being higher than the first pressure.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of the present invention will be explained hereinafter with reference to the accompanying drawings.

Figure 1:
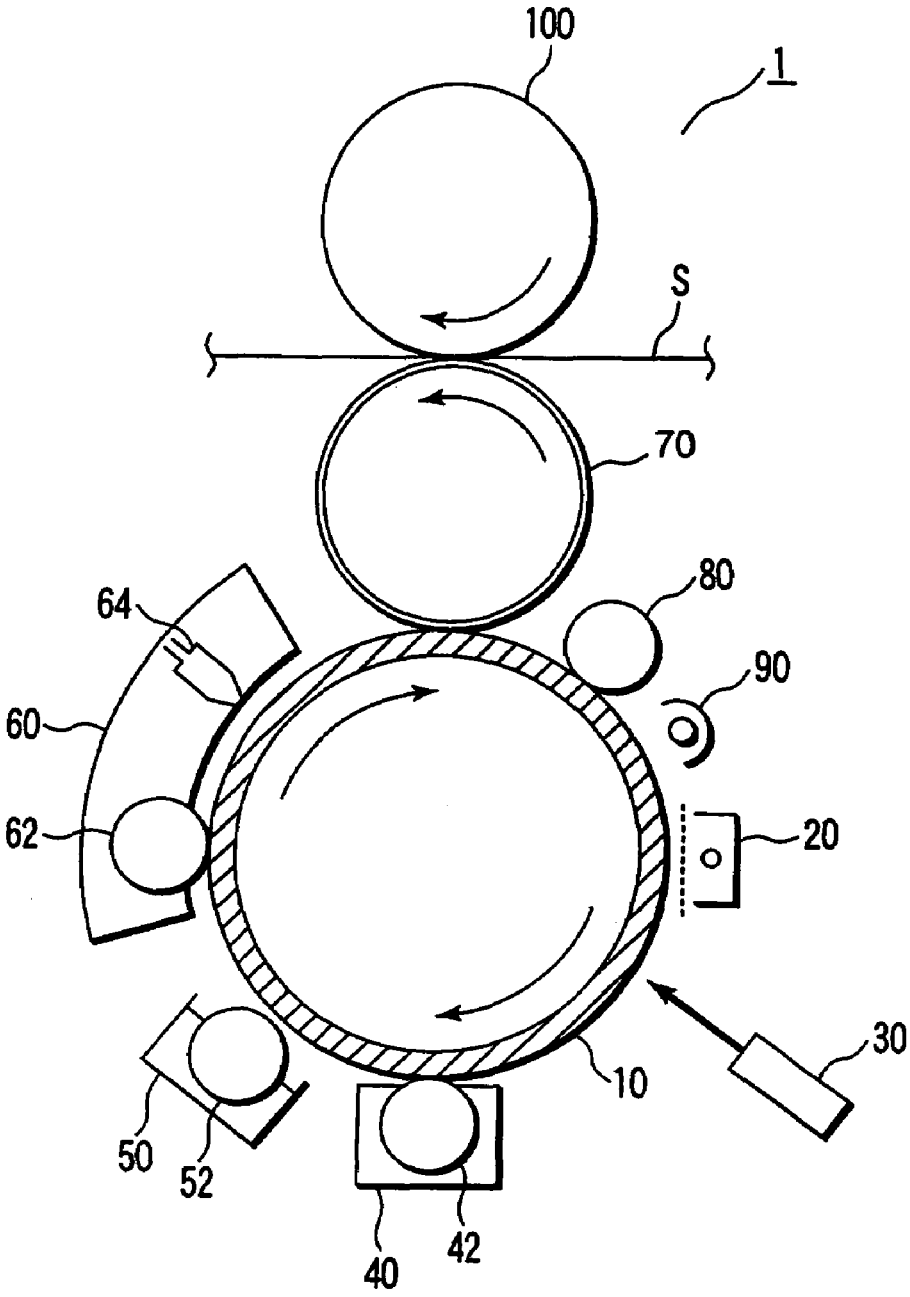
FIG. 1 is a schematic diagram of an image forming apparatus with liquid process according to an embodiment of the present invention.

FIG. 1 shows an image forming apparatus with the liquid process using a liquid developer including toner particles dispersed in a carrier liquid according to an embodiment of the present invention.

An image forming apparatus 1 shown in FIG. 1 includes an image holding unit 10, a charging unit 20, an exposing unit 30, a developing unit 40, a squeezing unit 50, a drying unit 60, an intermediate transfer member 70, a photosensitive member cleaning unit, a discharging unit 90, and a transfer unit 100.

The image holding unit 10 includes a photosensitive member 12 and a rotary axis 13 provided in the axis of rotation of the photosensitive member 12. The photosensitive member 12 is formed by providing an organic or amorphous silicon photosensitive layer with the thickness of 10–40 μm on the curved surface (outer circumference) of a cylindrical conductive base. It is preferable to provide a surface lubricant layer made of resin with excellent wear proof (not shown) on the outermost surface of the photosensitive layer, to prevent adhesion of toner particles. A fixed area close to the center in the longitudinal direction of the photosensitive member 12 (an area inside a fixed distance from both end portions 16) is an image area (a drawing area) 14 where image information is exposed by an exposing unit as described later.

The charging unit 20 is placed opposite to the surface of the photosensitive member 12 through a gap of 1–2 mm, for example, and charges evenly the surface of the photosensitive member 12.

The exposing unit 30 forms an electrostatic latent image defined by an image or an exposed portion and a non-image or a non-exposed portion, by applying a laser beam for example, modulated based on the image information selectively to the image area 14 of the photosensitive member 12 charged evenly by the charging unit 20. In this time, the image area 14 on the photosensitive member 12 exposed by the exposing unit 30 is set a little wider (several millimeters maximum) than the maximum width of paper where an image can be formed by the image forming apparatus 1 (e.g., in the direction where the short side of a A3 paper sheet or the long side of a A4 paper sheet is parallel to the rotary axis 13 of the photosensitive member 12). Of course, in the normal image forming operation, image information is not exposed by the exposing unit 30 in a non-image area (both end portions) 16 on the surface of the photosensitive member out of the image area 14.

The developing unit 40 supplies the photosensitive member 12 with a liquid developer containing a fixed amount of toner particles dispersed in a carrier liquid by a developing roller 42, makes the toner particles adhere to the image formed by the selective exposing by the exposing unit 30 and develops the image, and forms a visible image on the image area 14 of the photosensitive member 12. A pump or a liquid circulating system (not shown) is used for supplying and exhausting the liquid developer to/from the developing unit 40.

The squeezing unit 50 has a squeezing roller 52 placed opposite to the surface of the photosensitive member 12 with a clearance of 20–50 μm, and squeezes the carrier liquid adhered to the photosensitive member 12 on which a visible image is formed by the developing unit 40.

The drying unit 60 eliminates further the carrier liquid not completely squeezed from the photosensitive member 12 by the squeezing roller 52 of the squeezing unit 50. The drying unit 60 has an absorbing roller mechanism 62 which contacts the surface of the photosensitive member 12 and the visible image formed on the photosensitive member 12, and absorbs a part of the carrier liquid adhered to the surface of the photosensitive member 12 and the visible image, and a blower 64 which blows air to the surface of the photosensitive member 12 and the visible image to quicken the drying after the absorbing roller mechanism 62 absorbs the carrier liquid.

The blower 64 is provided with a gap of about 1 mm from the surface of the photosensitive member 12, and supplies an air flow (wind) of 4 to 6 $m^3$/min to the surface of the photosensitive member 12.

The intermediate transfer member 70 is formed to keep the surface at a fixed temperature (about 80° C.), and pressed to the photosensitive member 12 to transfer a visible image (from the photosensitive member 12) by the heat and pressure generated in the part where the intermediate transfer member contacts the photosensitive member 12.

The photosensitive member cleaning unit 80 eliminates the toner particles remained on the photosensitive member 12 after a visible image is transferred to the intermediate transfer member 70.

The discharging unit 90 discharges the photosensitive member 12 evenly after the toner particles are eliminated by the photosensitive member cleaning unit 80 (returns the charged part of the photosensitive member 12 to the initial state (before the charging).

The transfer unit 100 is pressed to the intermediate transfer member 70 by a force of fixed strength. The transfer unit 100 is formed to keep the surface at a fixed temperature (about 120° C.), and transfers a visible image held by the intermediate transfer member 70 to a sheet-like transfer medium S guided between the transfer unit 100 and intermediate transfer member 70, by the heat and pressure generated in the part contacting with the intermediate transfer member 70. The visible image transferred to the transfer medium S is fixed to the transfer medium (sheet) S by the pressure and the temperature to keep it (about 80° C. and 120° C.) between the intermediate transfer member 70 and transfer unit 100.

The liquid developer is formed by dispersing a hydrocarbon-based insulating solvent in the carrier liquid as a toner particle with average cubit diameter of about 0.8 μm containing a pigment component having a glass transition point of about 45° C., by using an acrylic-based polymer as a binder resin. A toner particle is charged to a positive polarity in the state dispersed in the carrier liquid.

Figure 2:
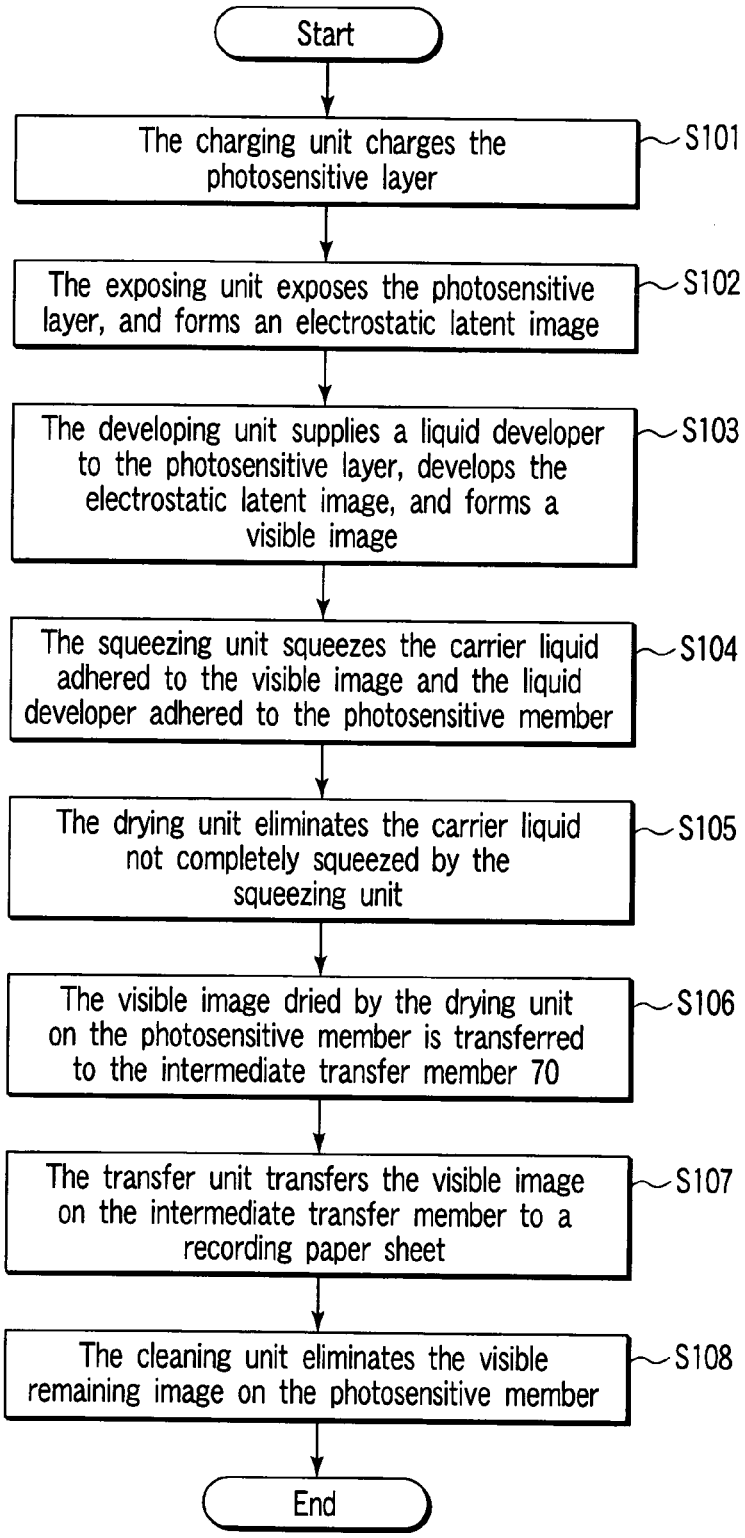
FIG. 2 is a flowchart for explaining an example of the operations of the image forming apparatus shown in FIG. 1.

Now, explanation will be given on the operation of the image forming apparatus 1 shown in FIG. 1 with reference to the flowchart of FIG. 2. First, the charging unit 20 charges evenly the photosensitive member 12 which has been discharged evenly by the discharging unit 90 and rotated at a fixed speed (step 101). In this embodiment, the photosensitive member 12 is charged to about +800V.

Next, the exposing unit 30 selectively exposes the image area 14 of the photosensitive member 12 which has been charged evenly by the charging unit 20, and forms an electrostatic latent image having an image area and a non-image area (step 102). In this embodiment, the potential of the image area or the exposed area of the photosensitive member 12 is about +200V.

The developing unit 40 develops the electrostatic latent image formed on the photosensitive member 12 with the liquid developer, and forms a visible image on the photosensitive member 12 (step 103). The surface of the developing roller 42 is moved at about double speed in the same direction as the movement of the photosensitive member 12, at the position opposite to the surface of the photosensitive member 12 (the rotation speeds of the developing roller 42 and photosensitive member 12 are defined to permit the moving speeds of these surfaces). The developing roller 42 is supplied with a voltage of about +600V. Therefore, on the surface of the photosensitive member 12, the potential of the part with the visible image formed by the developing roller 42 becomes about +300V.

The squeezing unit 50 squeezes the carrier adhered to the visible image formed on the photosensitive member 12 and the surplus liquid developer adhered to the other parts than the visible image (step 104). In this embodiment, the surface of the squeezing roller 52 is moved at about double speed in the direction opposite to the direction of moving the surface of the photosensitive member 12, at the position opposite to the surface of the photosensitive member 12 (the rotation speed of the squeezing roller 52 is defined to permit the moving speed of the surface). The squeezing roller 52 is supplied with a bias voltage of about 600V like the developing roller 42, and has the function of pushing (pushing back) the positive charged toner particle to the surface of the photoconductive member 12. Therefore, a fluid-like (electrostatic) squeezing effect is generated, and the solvent remained on the surface of the visible image is eliminated. As a result, the visible image thickness of more than 1 μm becomes half or less.

The drying unit 60 eliminates the carrier liquid not completely squeezed by the squeezing unit 50, by the absorbing roller mechanism 62, and then dries the visible image and the surface of the photosensitive member 12 by the blower 64 (step 105).

The dried visible image on the photosensitive member 12 is transferred to the intermediate transfer member 70 (step 106).

The transfer unit 100 transfers the (dried) visible image transferred already to the intermediate transfer member 70 to the transfer medium S guided between the intermediate transfer member 70 and transfer unit 100 (step 107).

The photosensitive member cleaning unit 80 eliminates the toner particles remained on the surface of the photosensitive member 12 (step 108). This completes the image forming operation.

Next, detailed explanation will be given on the configuration of the absorbing roller mechanism of the image forming apparatus shown in FIG. 1 with reference to FIG. 3 and FIG. 4.

Figure 3:
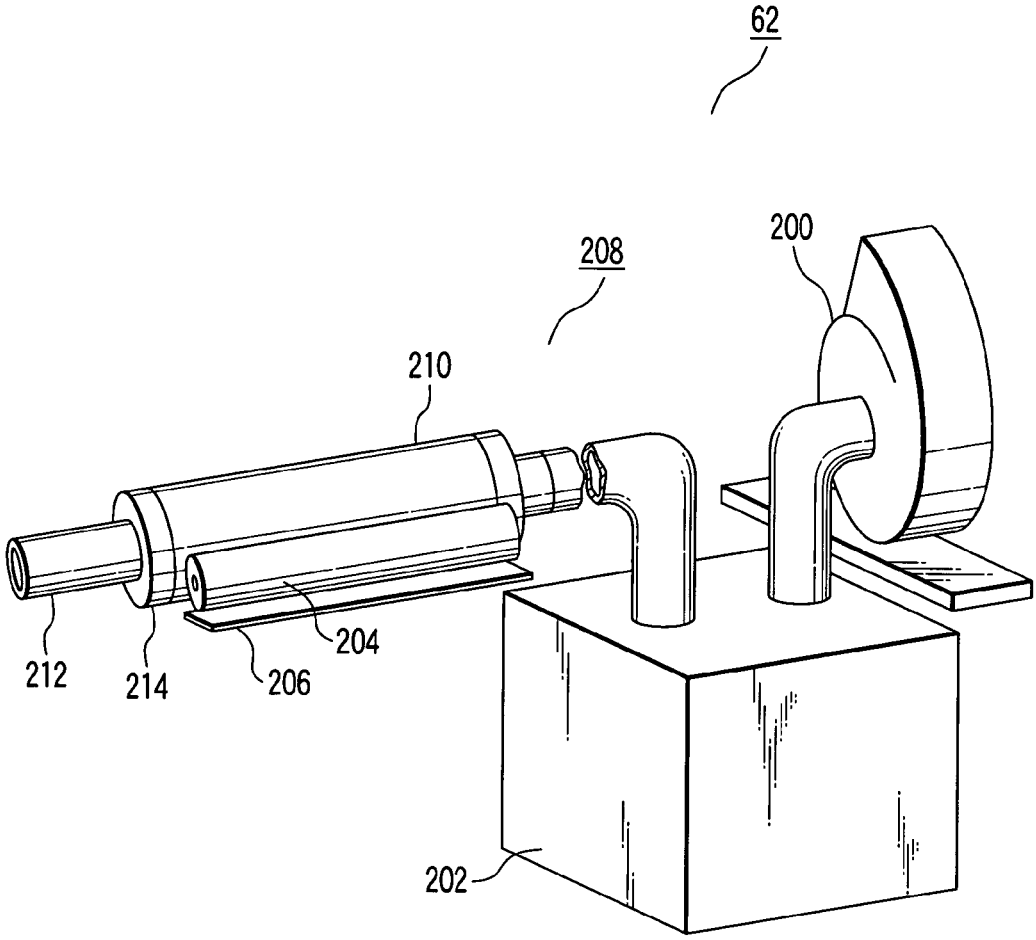
FIG. 3 is a schematic diagram of an absorbing roller mechanism of the image forming apparatus shown in FIG. 1.

As shown in FIG. 3, the absorbing roller mechanism 62 has an absorbing roller 208, a pump 200, a tank 202, a cleaning roller 204, and a cleaning blade 206.

The cleaning roller 204 is made of stainless steel having a mirror-finished insulating surface so as not to absorb the carrier liquid. The cleaning roller 204 contacts the absorbing roller 208 at a potential lower than the absorbing roller 208, and electrically absorbs the positive charged toner particles adhered to the absorbing roller 208.

The cleaning blade 206 is pressed to the cleaning roller 204 by a fixed pressure, and mechanically eliminates the toner particles adhered to the cleaning roller 204.

The absorbing roller 208 contacts the photosensitive member 12 and the visible image formed on the surface of the photosensitive member 12, and absorbs the carrier liquid remained on the surface of the photosensitive member 12 or among the toner particles forming the visible image. The surface potential of the absorbing roller 208 is held higher than the photosensitive member 12, and it is prevented that the positive charged toner particles adhered to the photosensitive member 12 are attracted to the absorbing roller 208.

The absorbing roller 208 includes a porous elastic member 210, a roller core 212, and two follower rollers (power receiving rollers) 214. The porous elastic member 210 is made of an electrically conductive smooth and breathable material with evenly dispersed minute holes (air vents). The porous elastic member 210 is made of polyurethane sponge, for example. The average diameter of the holes (air vents) of the porous elastic member 210 is preferably 30 μm or less on average. The roller core 212 is cylindrical and has not-shown holes (air vents) on the curved surface of the cylinder to give breathability. One end of the roller core 212 is airtight, and the other end is connected with the pump 200.

The diameters of the air vents of the porous elastic member 210 and roller core 212 are sufficiently larger than the average diameter of the toner particles. Therefore, even if the toner particles are mixed in the carrier liquid absorbed by the absorbing roller 208, the absorbing roller is pulled together with the toner particles into the hollow part of the roller core 212, and the surface of the absorbing roller 208 is held in the state with no toner particles adhered.

The pump 200 absorbs the hollow part of the roller core 212 to decrease the inside pressure lower than the outside, whereby the carrier liquid absorbed by the absorbing roller 208 can be taken into the roller core. Namely, when the pump 200 is operated, it is possible to absorb the carrier liquid absorbed through the not-shown air vents (on the cylindrical surface) of the roller core 212 toward the tank 202. The tank 202 holds the carrier liquid taken in the roller core 212.

The toner particles remained on the surface of the absorbing roller 208 without being completely absorbed in the roller core 212 by the absorbing force of the pump 200 are electrically eliminated from the absorbing roller 208 by the potential difference between the voltage applied to the cleaning roller 204 and the voltage applied to the absorbing roller 208. The toner particles absorbed (electrostatically) by the cleaning roller 204 are eliminated (mechanically) by the cleaning blade 206, and the surface of the absorbing roller 208 is kept in the state with no toner particles adhered.

The follower roller 214 is provided at two locations or at both ends of the cylindrical part of .the porous elastic member 210, to be concentric with the roller core 212. The follower roller 214 is made of hard rubber, and designed to have a rigidity much higher than the porous elastic member 210, and to have a frictional force larger than the porous elastic member 210 on the surface of the photosensitive member 12.

Figure 4A:
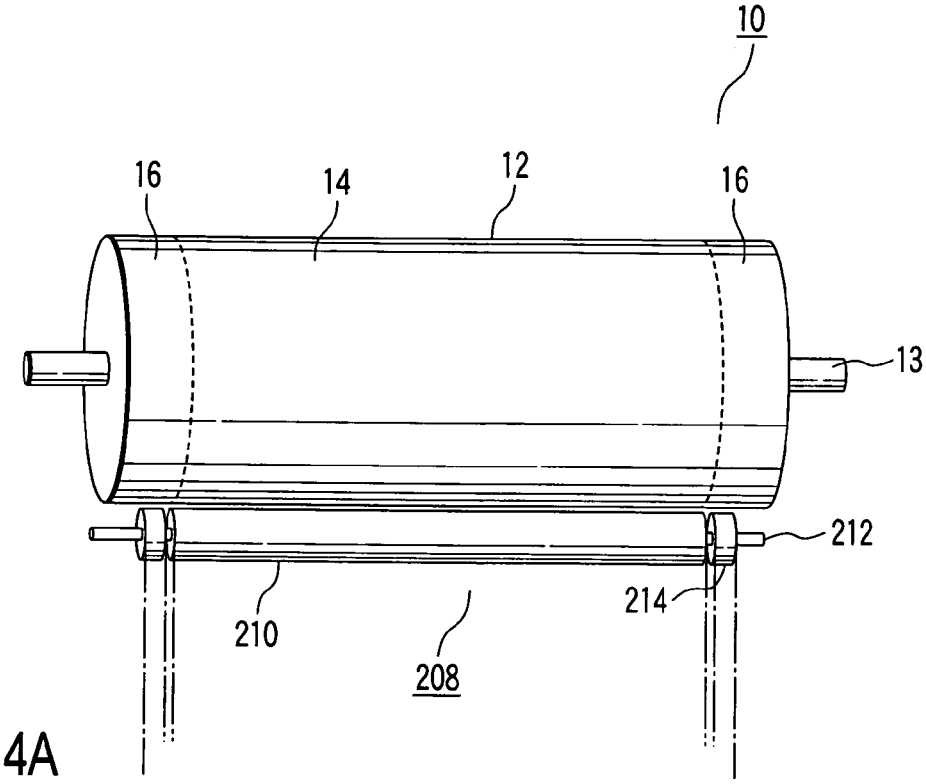
FIG. 4A is a schematic diagram of an absorbing roller incorporated in the absorbing roller mechanism shown in FIG. 3.

As shown in FIG. 4A, the follower roller 214 contacts the surface of the photosensitive member 12 in the non-image area (both end portions) 16 of the photosensitive member 12, keeps a constant gap between the roller core 212 and photosensitive member 12, and prevents undesired deformation of the porous elastic member 210. Further, the follower roller 214 receives the driving force (rotational force) from the photosensitive member 12 by the rotation of the photosensitive member 12, and rotates the absorbing roller 208 at a speed equal to the speed of the moving surface of the photosensitive member 12. Namely, the follower roller 214 rotates (moves) the absorbing roller 208 together with the movement (rotation) of the surface of the photosensitive member 12 at a substantially equal surface speed.

In this embodiment, the diameter of the follower roller 214 is defined to be about 200 μm smaller than the diameter of the porous elastic member 210. Therefore, when the absorbing roller 208 is pressed to the surface of the photosensitive member 12, the porous elastic member 210 is pressed to the photosensitive member 12 by a fixed pressure while elastically deformed, before the follower roller 214 comes in contact with the photosensitive member 12. In this time, the porous elastic member 210 forms a nip of a size (contacting length) sufficient to absorb a part of the carrier liquid adhered to the photosensitive member 12 and a part of the carrier liquid remained among the toner particles of the visible image formed on the photosensitive member 12, in the part contacting with the photosensitive member 12.

Figure 4B:
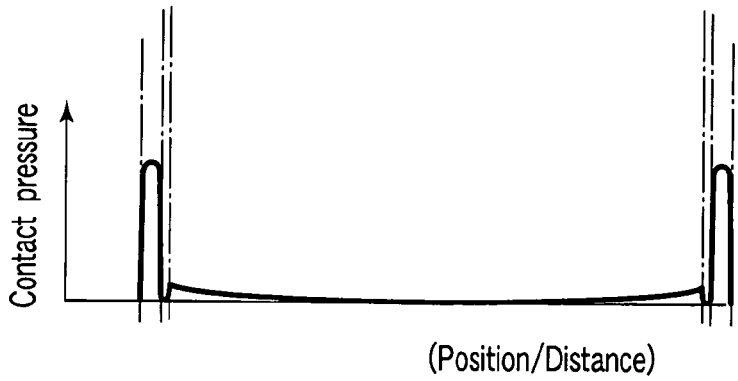
FIG. 4B is a graph showing the distribution of the contact pressure of the absorbing roller to a photosensitive member of an image holding unit shown in FIG. 4A.

As shown in FIG. 4B, the contact pressure in the part where the follower roller 214 contacts the photosensitive member 12 is higher than the contact pressure in the part where the porous elastic member 210 of the absorbing roller 208 contacts the photosensitive member 12. Namely, the outside diameter of the porous elastic member 210 is larger than the follower roller 214, but the contact pressure is concentrated on the contacting part of the follower roller 214 having a higher rigidity. Thus, the force of pressing the absorbing roller 208 to the surface of the photosensitive member 12 is efficiently converted to a surface pressure between the follower roller 214 and photosensitive member 12, that is, a frictional force. As a result, the pressing force of the porous elastic member 210 of the absorbing roller 208 required to obtain a sufficient driving force can be reduced compared with a case when the follower roller 214 is not provided. This decreases the load to the whole absorbing roller 208 to drive the absorbing roller 208, which is to be shared by the absorbing roller 208. This improves the life of the whole absorbing roller 208, especially the porous elastic member 210.

The contact pressure in the nip of the porous elastic member 210 to contact the visible image is not unnecessarily increased (the contact pressure in the nip is kept at a fixed pressure), and the visible image on the photosensitive member 12 is not transferred to the porous elastic member 210. This prevents a disturbance in a visible image such as a ghost image (re-transfer of the visible image adhered to the porous elastic member (the surface of the absorbing roller 208) to the surface of the photosensitive member 12).

Moreover, the amount of deformation (of the absorbing roller 208) is controlled by the follower roller 214, and the driving force in the nip is not loaded to the absorbing roller. This decreases the load of the porous elastic member 210, and improves the life of the porous elastic member 210.

Figure 5:
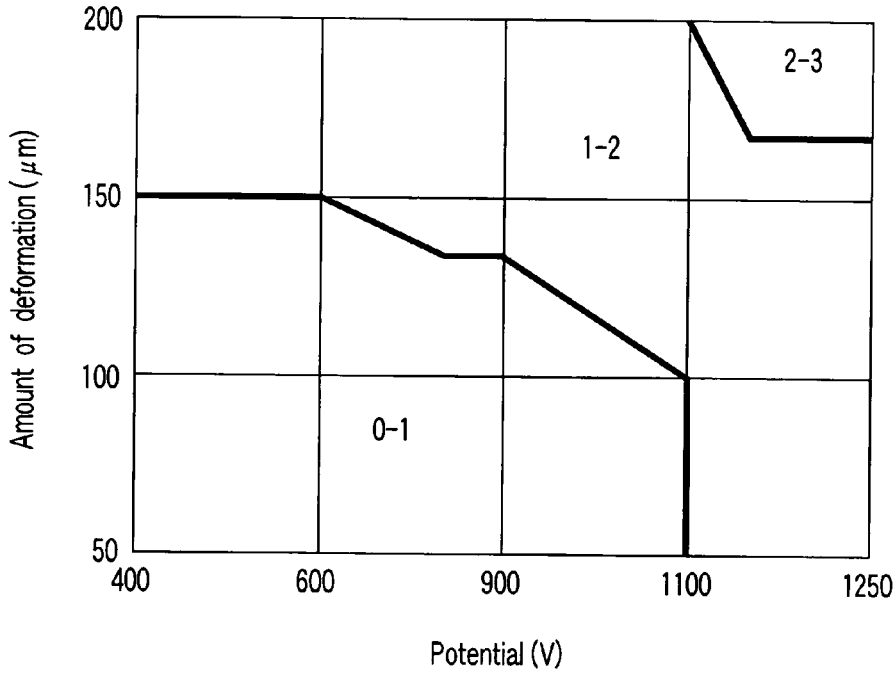
FIG. 5 is a graph showing the results of subjective evaluation of the density of a ghost image in reference to the voltage applied to the absorbing roller and the amount of deformation in the diameter direction of the absorbing roller, in the state that the absorbing roller and photosensitive member are contacting as shown in FIGS. 4A and 4B.

FIG. 5 shows the result of subjective evaluation of the density of ghost image, with the surface potential of the porous elastic member 210 on the horizontal axis, and the amount of deformation in the diameter direction of the porous elastic member 208 generated when the absorbing roller 208 is pressed to the surface of the photosensitive member 12, on the vertical axis. The evaluation is made in four ranks. When no ghost image occurs, the rank is 0. Ranks 1 to 3 indicate the density of ghost image.

It is seen from FIG. 5 that as the amount of deformation of the porous elastic member 210 is increased, that is, the contact pressure in the nip of the porous elastic member 210 contacting a visible image is increased, a ghost image occurs frequently. In the configuration of this embodiment, the contact pressure in the nip of the porous elastic member 210 to contact a visible image is not unnecessarily increased, and a disturbance in a visible image such as a ghost image can be prevented.

As explained above, by providing a roller (a follower roller) which receives the rotation of a photosensitive member while supplying a contact pressure higher than the contact pressure of the porous elastic roller in the image area of a photosensitive member when contacting a photosensitive member in the non-image area, a speed difference (relative speed) between the photosensitive member and porous elastic roller can be prevented. This enables to keep an optimum pressure to press the porous elastic member to the surface of a photosensitive member. As a result, a disturbance in a visible image such as a ghost image can be prevented.

Figure 6A:
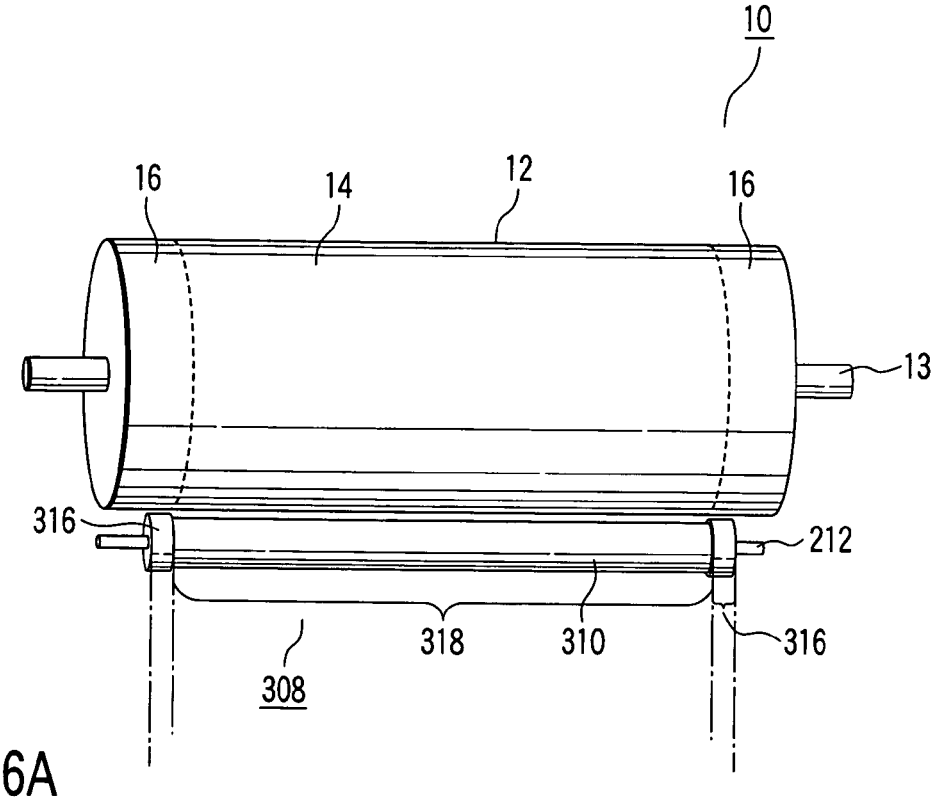
FIG. 6A is a schematic diagram for explaining another embodiment of the absorbing roller incorporated in the absorbing roller mechanism shown in FIG. 3.

FIG. 6A shows another embodiment of the absorbing roller explained with reference to FIG. 4A. To discriminate from the embodiment of FIG. 4A, 100 is added to the reference numerals (order of 300) denoting the essential parts of an absorbing roller shown in FIG. 6A.

In an absorbing roller 308 shown in FIG. 6A, the both end portions 316 in the longitudinal direction of a porous elastic member 310 or the diameter of the part to contact the non-image area 16 of the photosensitive member is made larger than the diameter of the part to contact the image area 14 of the photosensitive member 12. Therefore, the diameter of a central portion 318 in the longitudinal direction of the porous elastic member 310 of the absorbing roller 308 opposite to the image area 14 of the photosensitive member 12 is smaller than the diameter of both end portions 316.

Figure 6B:
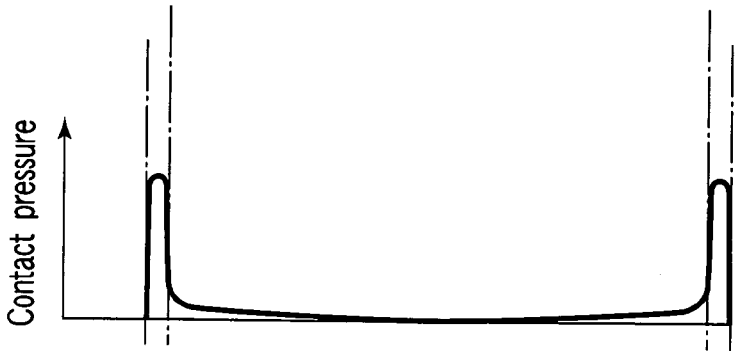
FIG. 6B is a graph showing the distribution of the contact pressure in the absorbing roller and the photosensitive member of image holding unit shown in FIG. 6A.

As shown in FIG. 6A, the absorbing roller 308 is pressed so that both central portion 318 and end portions 316 are brought into contact with the photosensitive member 12. Since the diameters of the central portion 318 and end portions 316 of the absorbing roller 308 are different, the contact pressure and the amount of deformation can be made different in the central portion 318 and end portions 316, as shown in FIG. 6B.

As a result, the contact pressure of the porous elastic member 310 to the photosensitive member 12 is concentrated on the two end portions 316 of the absorbing roller 308, and the contact pressure in the nip of the central portion 318 to contact a visible image is not increased unnecessarily and can be controlled to a fixed pressure.

Therefore, the visible image on the photosensitive member 12 is not transferred to the absorbing roller 308, and a disturbance in a visible image such as a ghost image can be prevented.

Further, since the contact pressure of the porous elastic member 310 to the photosensitive member 12 is concentrated on the end portions 316 of the absorbing roller 308, and the force of pressing the absorbing roller 308 to the photosensitive member 12 is efficiently converted to a surface pressure between the two roller end portions 316 and photosensitive member 12, that is, a frictional force.

As a result, the pressing force of the porous elastic member 310 of the absorbing roller 308 to the photosensitive member 12 can be reduced compared with a case when the diameter of the porous elastic member 310 of the absorbing roller 308 is even. This decreases the load to the whole absorbing roller 308, and improves the life of the whole absorbing roller 308.

As explained above, by enabling the absorbing roller to be pressed (to the surface of the photosensitive member) so that the contact pressure between the absorbing roller and photosensitive member in the image area becomes higher than the contact pressure (between the absorbing roller and photosensitive member) in the non-image area, a speed difference (relative speed) between the photosensitive member surface and porous elastic member can be prevented. This enables to keep the pressing force from the photosensitive member to the porous elastic member optimum. As a result, a disturbance in a visible image such as a ghost image can be prevented.

Figure 7:
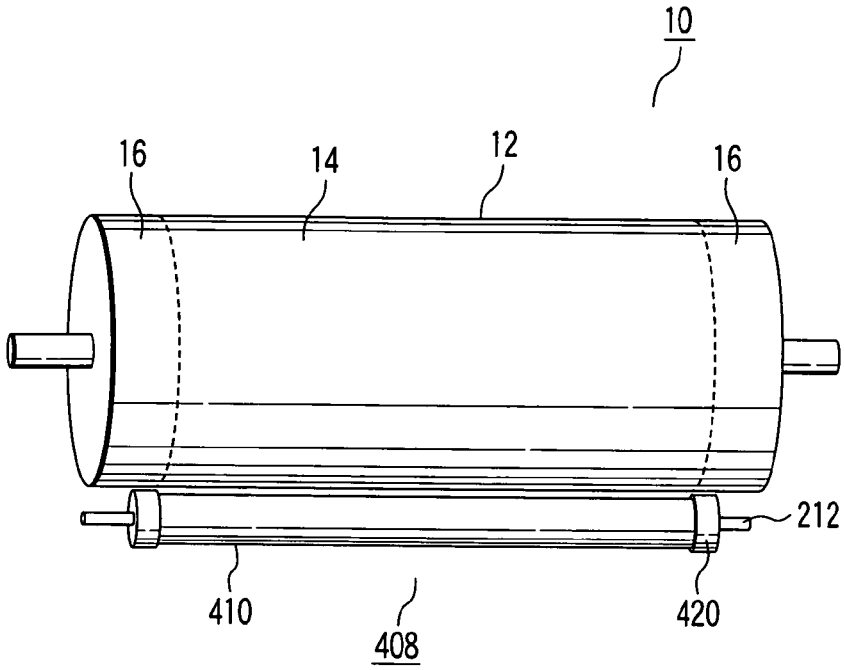
FIG. 7 is a schematic diagram for explaining another embodiment of the absorbing roller incorporated in the absorbing roller mechanism shown in FIG. 3.

FIG. 7 shows another embodiment of the absorbing roller explained with reference to FIG. 4A or FIG. 6A. To discriminate from the embodiment of FIG. 4A and FIG. 6A, reference numerals of the order of 400 are given to the essential parts of an absorbing roller shown in FIG. 7.

The absorbing roller 408 shown in FIG. 7 is provided with a follower ring 420 at both end portions 418 in the longitudinal direction of a porous elastic member 410, that is, at the position to contact the non-drawing area 16 of the photosensitive member 12. The diameter of the follower ring 420 is larger than the diameter of a central portion 416 in the longitudinal direction of the porous elastic member 410, that is, the position to contact the image area 14 of the photosensitive member 12. Namely, the porous elastic member 419 is located inside the ring of the follower ring 420. The follower ring 420 is preferably fit into the porous elastic member 410 (setting the inside diameter of the follower ring 420 smaller than the outside diameter of the porous elastic member 410).

The absorbing roller 408 is pressed so that both the central portion 416 and follower ring 420 come in contact with the photosensitive member 12. Since the diameters of the central portion 416 of the absorbing roller 408 and the follower ring 420 are different, the contact pressure and the amount of deformation are set independently for the central portion 416 and follower ring 420.

The contact pressure of the absorbing roller 408 to the photosensitive member 12 is concentrated on the part where the follower ring 420 contacts the photosensitive member 12, and the contact pressure in the nip of the central portion 416 to contact a visible image can be set to a fixed pressure range (as an upper limit) without increasing the pressure unnecessarily.

Therefore, it becomes difficult to transfer a visible image from the photosensitive member 12 to the porous elastic member 410 of the absorbing roller 408, preventing a disturbance in a visible image such as a ghost image.

The contact pressure of the absorbing roller 408 to the photosensitive member 12 is concentrated on the part where the follower ring 420 contacts the photosensitive member 12. Therefore, the pressure between the porous elastic member 410 of the absorbing roller 408 and the photosensitive member 12 is efficiently converted to a surface pressure between the follower ring 420 and photosensitive member 12, that is, a frictional force. As a result, the pressure of the absorbing roller 408 pressing on the photosensitive member 12 is controlled to be smaller than that when the follower ring 420 is not provided. Namely, the load to the whole absorbing roller 408 becomes small, and the life of the whole absorbing roller 408 is improved.

As described above, by pressing the absorbing roller to the photosensitive member so that the contact pressure in the non-image area of the photosensitive member is higher than that in the image area of the photosensitive member, a speed difference (relative speed) between the photosensitive member and the porous elastic member of the absorbing roller can be prevented. This enables to keep the pressing force of the porous elastic member on the photosensitive member optimum. As a result, a disturbance in a visible image such as a ghost image can be prevented.

In the above explanation, the follower ring 420 is fitted into the porous elastic member 410. However, it is permitted to make the porous elastic member ring-shaped by sticking a belt-shaped material with a fixed thickness for the ring (420) to the circumference of the porous elastic member 410. It is also permitted to form a ring (420) at the end of the porous elastic member 410 by immersion coating.

Figure 8:
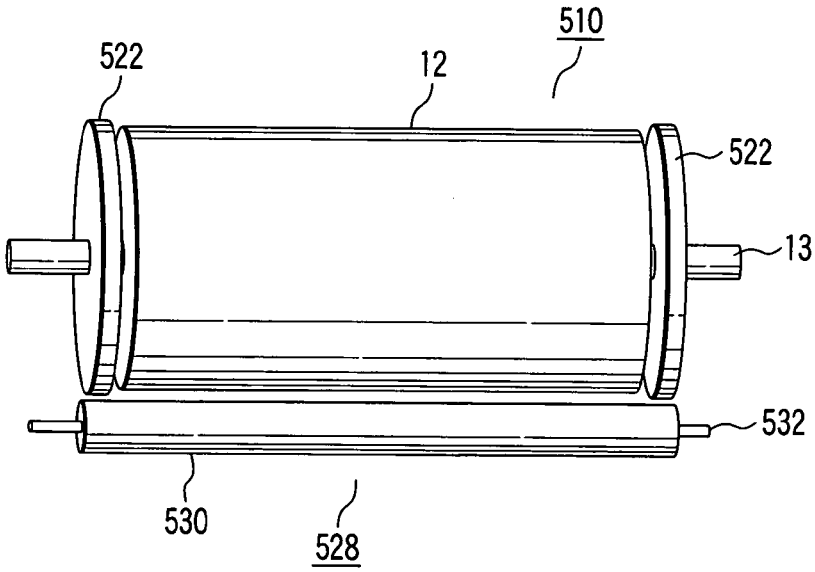
FIG. 8 is a schematic diagram for explaining an embodiment of an image holding unit used in combination with the absorbing roller mechanism shown in FIG. 3.

FIG. 8 shows an embodiment different from those explained with reference to FIG. 4A, FIG. 6A or FIG. 7.

To discriminate from the previously explained embodiments, reference numerals of the order of 500 are given to the essential parts of the embodiment shown in FIG. 8.

In FIG. 8, an image holding unit 510 is provided with a pair of driving rollers 522 on the same axis as the rotary axis 13 of the photosensitive member 12, and on both sides of the photosensitive member 12.

With this structure, an absorbing roller 528 may be composed of a porous elastic member 530 and a roller core 532. The length in the axial direction is defined longer those in the examples shown in FIG. 4A, FIG. 6A or FIG. 7.

Namely, in the example shown in FIG. 8, the porous elastic member 530 (and roller core 532) of the absorbing roller 528 is formed to have an even diameter and have a length able to contact simultaneously with two driving rollers 522 provided at both ends of the photosensitive member 12.

In the image holding unit 510, the driving roller 522 is formed larger than the photosensitive member 12 in the diameter and concentric with the photosensitive member 12, and rotated together with the photosensitive member 12.

In FIG. 8, the absorbing roller 528 is pressed so that the porous elastic member 530 comes in contact with both photosensitive member 12 and driving roller 522. Since the diameters of the photosensitive member 12 and driving roller 522 are different, the contact pressure and the amount of deformation of the porous elastic member 530 (of the absorbing roller 528) can be made different in the part to contact the photosensitive member 12 and the part to contact the driving roller 522.

The contact pressure of the porous elastic member 503 of the absorbing roller 528 to the photosensitive member 12 is concentrated on the part that contacts the driving roller 522, the contact pressure at the nip of the porous elastic member 530 that contacts a visible image cannot be increased unnecessarily. As a result, this avoids the transfer of a visible image from the photosensitive member 12 to the absorbing roller 528, preventing a disturbance in a visible image such as a ghost image.

Further, the contact pressure of the porous elastic member 530 of the absorbing roller 528 to the photosensitive member 12 is concentrated on the part that contacts the two driving rollers 522, and the force of pressing the absorbing roller 528 to the photosensitive member 12 is efficiently converted to a surface pressure between the driving roller 522 and photosensitive member 12, that is, a frictional force. As a result, the pressing force of the porous elastic member 510 of the absorbing roller 528 to the image area 14 of the photosensitive member 12 can be made smaller than that when the driving roller 522 is not provided. Since the load on the whole absorbing roller 528 becomes small, the life of the absorbing roller 528 is improved.

As described above, by pressing the absorbing roller onto the photosensitive member so that the contact pressure of the porous elastic member (absorbing roller) onto the non-image area of the photosensitive member is higher than the contact pressure between the porous elastic member and the image area of the photosensitive member, a speed difference (relative speed) between the photosensitive member and porous elastic member can be prevented. Further, the pressing force between the porous elastic member and the photosensitive member surface can be kept optimum, and a disturbance in a visible image such as a ghost image can be prevented.

Figure 9:
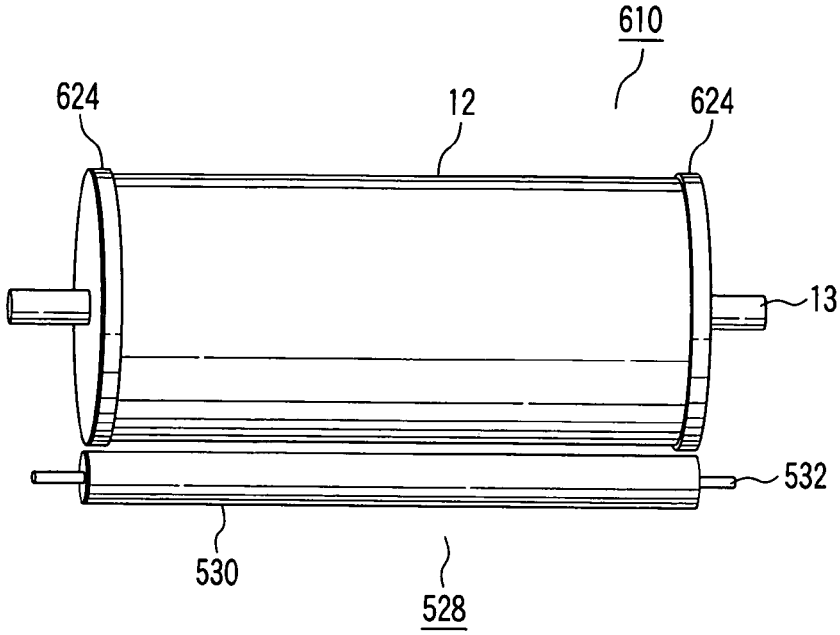
FIG. 9 is a schematic diagram for explaining another embodiment of an image holding unit used in combination with the absorbing roller mechanism shown in FIG. 3.

FIG. 9 shows an embodiment different from those explained with reference to FIG. 4A, FIG. 6A, FIG. 7 or FIG. 8. To discriminate from the previously explained embodiments, reference numerals of the order of 600 are given to the essential parts of the embodiment shown in FIG. 9.

An image holding unit 610 of the embodiment shown in FIG. 9 has a driving ring 624 fitted to the outer circumference of the photosensitive member 12 at both end portions of the photosensitive member 12, that is, in an area 16 that does not pass a paper sheet. The porous elastic member 530 of the absorbing roller 528 that contacts the photosensitive member 12 (given the same structure as the absorbing roller shown in FIG. 8) is formed to have an even diameter and have a length longer than the photosensitive member 12 and able to contact simultaneously with two driving rings 624.

The driving ring 624 is formed larger than the photosensitive member 12 in the diameter and concentric with the photosensitive member 12, and rotated together with the photosensitive member 12.

The absorbing roller 528 is pressed to come in contact with both photosensitive member 12 and driving ring 624. Since the diameters of the photosensitive member 12 and driving roller 624 are different, the contact pressure and the amount of deformation of the absorbing roller 528 can be made different in the part to contact the photosensitive member 12 and the part to contact the driving ring 624.

The contact pressure of the absorbing roller 528 to the photosensitive member 12 is concentrated on the part to contact the driving ring 524, the contact pressure in the nip of the porous elastic member 530 to contact a visible image cannot be increased unnecessarily. As a result, it becomes difficult to transfer a visible image from the photosensitive member 12 onto the absorbing roller 528, preventing a disturbance in a visible image such as a ghost image.

Further, the contact pressure of the absorbing roller 528 to the photosensitive member 12 is concentrated on the part to contact the driving rollers 624, and the force of pressing the absorbing roller 528 to the image holding unit 610 is efficiently converted to a surface pressure between the driving roller 624 and photosensitive member 12, that is, a frictional force. As a result, the pressing force between the absorbing roller 528 and the image holding unit 610 can be made smaller than that when the driving ring 624 is not provided. As the load to the whole absorbing roller 528 becomes small, the life of the absorbing roller 528 is improved.

The contact pressure in the nip of the porous elastic member 530 that contacts a visible image cannot be increased unnecessarily, and it becomes difficult to transfer a visible image from the photosensitive member 12 onto the absorbing roller 528. As a result, a disturbance in a visible image such as a ghost image can be prevented.

As described above, by pressing the absorbing roller so that the contact pressure in the non-drawing area of the photosensitive member is higher than the contact pressure in the drawing area of the photosensitive member, it becomes possible at the same time to prevent a relative speed between the porous elastic member and image holding unit and to keep the pressing force between the porous elastic member and the image holding unit optimum. As a result, a disturbance in a visible image such as a ghost image can be prevented.

In the above explanation, the driving ring 624 is fitted to the photosensitive member 12. However, it is permitted to make the photosensitive member 12 ring-shaped (624) by sticking a belt-shaped material onto the photosensitive member 12. Otherwise, a ring (624) may be formed at the end of the photosensitive member by immersion coating.

Figure 10:
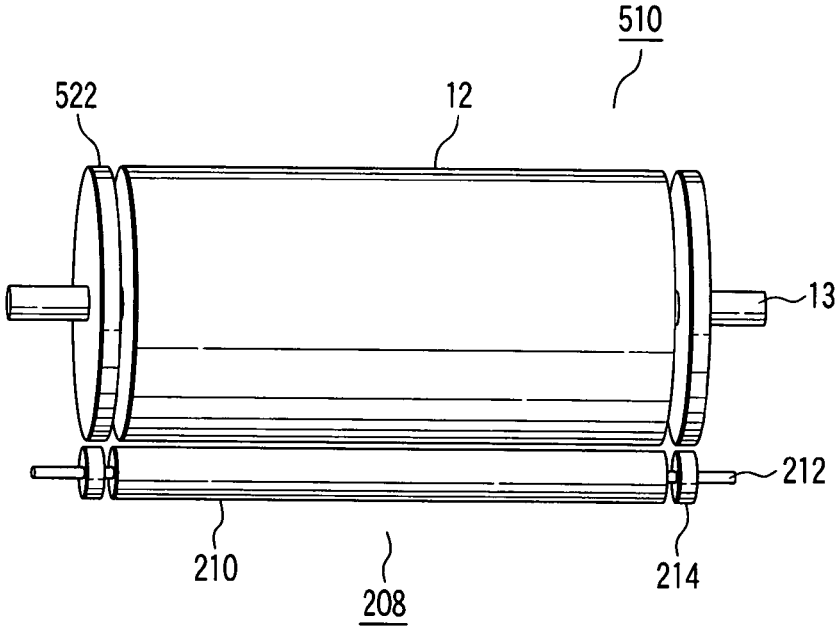
FIG. 10 is a schematic diagram for explaining another embodiment of an image holding unit used in combination with the absorbing roller mechanism shown in FIG. 3.

FIG. 10 shows an embodiment different from those explained with reference to FIG. 4A, FIG. 6A, FIG. 7 or FIG. 9.

In FIG. 10, an image holding unit 510 (given the same structure as the example shown in FIG. 8) has two driving rollers 522 on the same axis of the photosensitive member 12, opposite to both sides of the photosensitive member 12. The absorbing roller 208 (given the same structure as the example shown in FIG. 4A) to contact the photosensitive member 12 has two follower rollers 214 on the same axis of the porous elastic member 210, opposite to both sides of the porous elastic member 210. The driving roller 522 and follower roller 214 come in contact with each other.

The sum of the radii of the driving roller 522 and follower roller 214 is designed smaller than the sum of the radii of the photosensitive member 12 and porous elastic member 210.

The contact pressure of the absorbing roller 208 to the photosensitive member 12 is concentrated on the position where the driving roller 522 comes in contact with the follower roller 214, and the contact pressure in the nip of the porous elastic member 210 to contact a visible image cannot be increased unnecessarily. As a result, it becomes difficult to transfer a visible image from the photosensitive member 12 to the absorbing roller 208, preventing a disturbance in a visible image such as a ghost image.

The contact pressure of the absorbing roller 208 to the photosensitive member 12 is concentrated on the position where the driving roller 522 comes in contact with the follower roller 214, and the force of pressing the absorbing roller 208 to the image holding unit 10 is efficiently converted to a surface pressure between the driving roller 522 and follower roller 214, that is, a frictional force. As a result, the pressing force of the absorbing roller 208 pressing onto the image holding unit 10 required to obtain a sufficient driving force can be set smaller that that when the driving roller 522 and follower roller 214 are not provided. The load on the whole absorbing roller 208 becomes small, and the life of the whole absorbing roller 208 is improved.

As described above, by pressing the absorbing roller so that the contact pressure in the non-drawing area of the photosensitive member is higher than the contact pressure in the drawing area of the photosensitive member, it becomes possible at the same time to prevent a relative speed between the porous elastic member and image holding unit and to keep the pressing force of the porous elastic member to the image holding unit optimum. As a result, a disturbance in a visible image such as a ghost image can be prevented.

Figure 11:
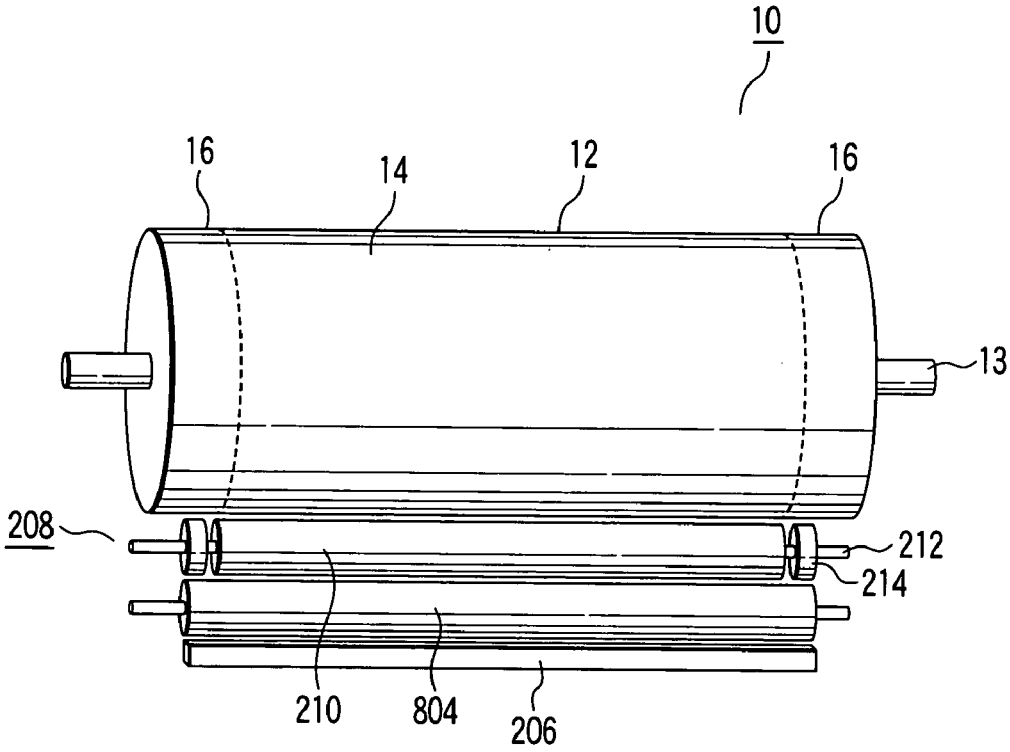
FIG. 11 is a schematic diagram for explaining a further embodiment of an absorbing roller incorporated in the absorbing roller mechanism shown in FIG. 3.

FIG. 11 shows an embodiment different from those explained with reference to FIG. 4A, FIG. 6A, FIG. 7 or FIG. 10. In the example shown in FIG. 11, the image holding unit and absorbing roller use the image holding unit 10 and absorbing roller 208 explained with reference to FIG. 4A. To discriminate from the previously explained embodiments, reference numerals of the order of 700 are given to the essential parts of the embodiment shown in FIG. 11.

The absorbing roller mechanism shown in FIG. 11 is different from the absorbing roller mechanism shown in FIG. 4A in the point that the cleaning roller is a stainless steel roller 808 having a mirror-finished insulating surface so as not to absorb a carrier liquid.

The cleaning roller 804 contacts the absorbing roller 208 at a potential lower than the absorbing roller 208, and electrically absorbs the positive charged toner particles adhered to the absorbing roller 208. The cleaning blade 206 contacts the cleaning roller 804, and mechanically eliminates the toner particles adhered to the cleaning roller 804.

In this embodiment, the cleaning roller 804, which contact the porous elastic member 210, is formed to have a length so that the follower roller 214 is also contacted.

The cleaning roller 804 eliminates toner particles not only from the porous elastic member 210 but also from the follower roller 214. This cleans the surface of the follower roller 214, and maintains the friction in the contacting part of the image holding unit 10 and follower roller 214 (at a fixed condition), preventing a difference in speed between these two members (a rotation speed difference between the image holding unit 10 and follower roller 214).

Further, as the cleaning roller 804 is rotated with the follower roller 214 by the frictional force generated between them, it is unnecessary to provide an independent driving mechanism.

In the above description, a drum-shaped photosensitive member is used in the embodiments. But, it is permitted to use a rigid member or an aluminum drum (cylindrical) covered with a sheet with a photosensitive layer, or an elastic ring-shaped belt covered with a photosensitive layer.

A laser is used to form an electrostatic latent image, but it is permitted to scan an LED turned on/off according to image information in parallel to the rotary axis (along the photosensitive member surface), or to use an array of LEDS.

A roller core is a cylinder having holes at desired positions, but it is permitted to use a porous sintered alloy, for example.

A non-drawing area is an area where image information is not exposed in a normal image forming operation, but it is not limited to an area where no image is formed. It is permitted to form a mark for positioning of an image in registration, for example.

As explained above, in the liquid-developing image forming apparatus using a liquid developer according to the present invention, the occurrence of a ghost image caused by the contact between the photosensitive member and the absorbing roller to collect a surplus liquid developer can be prevented with a simple configuration and at a low cost by preventing a speed difference (relative speed) between the porous member (absorbing roller) and photosensitive member and by maintaining an optimum pressing force between a porous member and a visible image on the photosensitive member.

The present invention is not limited to the above-mentioned embodiments. Various modifications are possible without departing from the essential characteristics. Embodiments may be combined appropriately as far as possible. When embodiments are combined, effects of combination will be obtained.

What is claimed is:

1. An image forming apparatus comprising:

a photosensitive member including a photosensitive surface containing an image area and non-image areas;

an image forming unit which forms an electrostatic latent image on the image area of the photosensitive surface of the photosensitive member;

a developing unit to develop the electrostatic latent image to form a visible image on the image area of the photosensitive surface of the photosensitive member by supplying the photosensitive surface of the photosensitive member with a carrier liquid and a liquid developer having toner particles; and an absorbing roller, being pressed to the image area and the non-image areas of the photosensitive surface of the photosensitive member, to absorb a part of the carrier liquid left on the photosensitive surface of the photosensitive member, wherein the image area of the photosensitive surface of the photosensitive member is pressed with a first pressure by the absorbing roller, while the non-image areas of the photosensitive surface of the photosensitive member are pressed with a second pressure higher than the first pressure by the absorbing roller.

2. The image forming apparatus according to claim 1, wherein the non-image areas of the photosensitive surface of the photosensitive member are end portions of the photosensitive surface of the photosensitive member.

3. The image forming apparatus according to claim 1, wherein the absorbing roller has a cylindrical porous elastic member to contact the image area of the photosensitive surface of the photosensitive member, and power receiving rollers which are provided opposite to each other at both end faces of the porous elastic member, contact the non-image areas of the photosensitive surface of the photosensitive member, and receive driving force from the non-image areas of the photosensitive surface of the photosensitive member.

4. The image forming apparatus according to claim 3, wherein each of the power receiving rollers has rigidity harder than the porous elastic member.

5. The image forming apparatus according to claim 3, wherein each of the power receiving rollers has a frictional force applied to each of the non-image areas of the photosensitive surface of the photosensitive member, the frictional force being larger than a frictional force of the porous elastic member applied to the image area of the photosensitive surface of the photosensitive member.

6. The image forming apparatus according to claim 3, wherein each of the power receiving rollers is smaller than the porous elastic member.

7. The image forming apparatus according to claim 1, wherein the absorbing roller has a porous elastic member in which diameters of both end portions are larger than a diameter of a central portion.

8. The image forming apparatus according to claim 1, wherein the absorbing roller has a cylindrical porous elastic member, and ring portions provided at both end portions of the porous elastic member.

9. The image forming apparatus according to claim 1, wherein the absorbing roller has a cylindrical porous elastic member, and power receiving rollers which are provided opposite to each other at both end portions of the cylindrical porous elastic member, and contact the non-image areas of the photosensitive surface of the photosensitive member, wherein the photosensitive member has driving rollers which are provided at both end portions and opposite to the power receiving rollers, and drives the power receiving rollers of the absorbing roller.

10. The image forming apparatus according to claim 3, further comprising:

a cleaning roller to contact both the porous elastic member and power receiving rollers.

11. An image forming apparatus comprising:

a photosensitive member including a photosensitive surface containing an image area and non-image areas;

an image forming unit which forms an electrostatic latent image on the image area of the photosensitive surface of the photosensitive member;

a developing unit to develop the electrostatic latent image to form a visible image on the image area of the photosensitive surface of the photosensitive member by supplying the photosensitive surface of the photosensitive member with a carrier liquid and a liquid developer having toner particles; and an absorbing roller, including a cylindrical porous elastic member to contact the image area of the photosensitive surface of the photosensitive member, and power receiving rollers which are provided opposite to each other at both end faces of the cylindrical porous elastic member, contact the non-image areas of the photosensitive surface of the photosensitive member and receive a driving force from the non-image areas of the photosensitive surface of the photosensitive member, the absorbing roller being pressed to the image area and the non-image areas of the photosensitive surface of the photosensitive member, to absorb a part of the carrier liquid left on the photosensitive surface of the photosensitive member, wherein the image area of the photosensitive surface of the photosensitive member is pressed with a first pressure by the cylindrical porous elastic member of the absorbing roller, while the non-image areas of the photosensitive surface of the photosensitive member are pressed with a second pressure higher than the first pressure by the power receiving rollers.

12. The image forming apparatus according to claim 11, wherein the image area of the photosensitive surface of the photosensitive member has a first hardness and each of the non-image areas of the photosensitive surface of the photosensitive member has a second hardness higher than the first hardness.

13. The image forming apparatus according to claim 11, wherein a diameter of an area of the absorbing roller to contact the non-image areas of the photosensitive surface of the photosensitive member is defined larger than a diameter of an area to contact the image area of the photosensitive surface of the photosensitive member.

14. The image forming apparatus according to claim 12, wherein a diameter of an area of the absorbing roller to contact the non-image areas of the photosensitive surface of the photosensitive member is defined larger than a diameter of an area to contact the image area of the photosensitive surface of the photosensitive member.

15. The image forming apparatus according to claim 1, wherein the photosensitive member is formed in a cylindrical shape.

16. The image forming apparatus according to claim 11, wherein the photosensitive member is formed in a cylindrical shape.

17. The image forming apparatus according to claim 15, wherein the non-image areas of the photosensitive surface of the photosensitive member are end portions of the photosensitive surface of the photosensitive member.

18. The image forming apparatus according to claim 16, wherein the non-image areas of the photosensitive surface of the photosensitive member are end portions of the photosensitive surface of the photosensitive member.

19. The image forming apparatus according to claim 11, wherein a diameter of an area of the absorbing roller to contact the non-image areas of the photosensitive surface of the photosensitive member is defined smaller than a diameter of an area to contact the image area of the photosensitive surface of the photosensitive member.

20. The image forming apparatus according to claim 12, wherein a diameter of an area of the absorbing roller to contact the non-image areas of the photosensitive surface of the photosensitive member is defined smaller than a diameter of an area to contact the image area of the photosensitive surface of the photosensitive member.

* * * * *